United States Patent [19]

Jungels-Butler et al.

[11] Patent Number: 4,916,262

[45] Date of Patent: Apr. 10, 1990

[54] LOW-PROFILE, RUBBER KEYPAD

[75] Inventors: Polly S. Jungels-Butler, Streamwood; Scott D. Beutler, Hoffman Estates, both of Ill.

[73] Assignee: Motorola, Inc., Schaumburg, Ill.

[21] Appl. No.: 266,749

[22] Filed: Nov. 3, 1988

[51] Int. Cl.[4] ..... H01H 13/70

[52] U.S. Cl. ..... 200/5 A; 200/515; 200/517; 200/306

[58] Field of Search ..... 200/5 R, 5 A, 86 R, 200/159 B, 306, 340, DIG. 1, 512, 513, 515, 517, 600

[56] References Cited

U.S. PATENT DOCUMENTS

| | | | |
|---|---|---|---|
| 3,699,294 | 10/1972 | Sudduth | 200/243 |
| 4,017,676 | 4/1977 | Larson | 200/5 A |
| 4,124,879 | 11/1978 | Schoemer | 362/26 |
| 4,271,333 | 6/1981 | Adams et al. | 200/5 A X |
| 4,314,116 | 2/1982 | Gordon | 200/5 A |
| 4,322,587 | 3/1982 | Burns et al. | 200/5 R |
| 4,323,740 | 4/1982 | Balash | 200/5 A |
| 4,343,975 | 8/1982 | Sado | 200/314 |
| 4,365,130 | 12/1982 | Christensen | 200/5 A X |
| 4,373,124 | 2/1983 | Frame | 200/5 A X |
| 4,499,343 | 2/1985 | Prioux et al. | 200/5 A |
| 4,596,905 | 6/1986 | Fowler | 200/5 A |
| 4,636,593 | 1/1987 | Novak et al. | 200/5 A |
| 4,684,767 | 8/1987 | Phalen | 200/5 A |

*Primary Examiner*—J. R. Scott

*Attorney, Agent, or Firm*—Rolland R. Hackbart

[57] ABSTRACT

A low-profile rubber keypad with good tactile feel and illuminability includes a plurality of layers adhesively bonded to one another. The top layer of the keypad is a silicone rubber overlay having a plurality of keys protruding therefrom. The rubber overlay is adhesively bonded to an actuation layer including a plurality of thin actuating strips. The actuation layer is adhesively bonded to a tactile layer including a plurality of collapsible resilient domes. The tactile layer is adhesively bonded to a shorting layer including a plurality of conductors. The shorting layer is adhesively bonded to a flex circuit layer including a plurality of conductors.

7 Claims, 2 Drawing Sheets

LOW-PROFILE, RUBBER KEYPAD

BACKGROUND OF THE INVENTION

The present invention is generally related to telephone keypads and more particularly to an improved low-profile, rubber keypad for use in cellular portable telephones.

Prior art low-profile keypads are available that have good tactile feedback but typically do not allow back illumination through the interconnect and switching circuitry. In order to provide for back illumination and good tactile feedback, a high-profile keypad incorporating plunger type actuator keys or self-tactile rubber keypads is required. Back illumination through such high-profile keypads is not possible since the keys incorporate a carbon conductor or a metallic popple, both of which are opaque. This problem has been solved in part by using a separate lightpipe (see U.S. Pat. No. 4,124,879) or a thick rubber pad as a lightpipe (see U.S. Pat. No. 4,636,593) to distribute the required illumination to the keys of the keypad. For the foregoing reasons, there is a need for an improved low-profile keypad that has good tactile feedback and back illuminability.

OBJECTS OF THE INVENTION

Accordingly, it is an object of the present invention to provide an improved low-profile rubber keypad with good tactile feedback and back illuminability.

It is another object of the present invention to provide an improved low-profile rubber keypad that has a floating rubber overlay with protruding keys.

It is yet a further object of the present invention to provide an improved low-profile rubber keypad that has an adhesive backing for surface mounting thereof as a component.

DESCRIPTION OF THE PREFERRED EMBODIMENT

Figure 1:
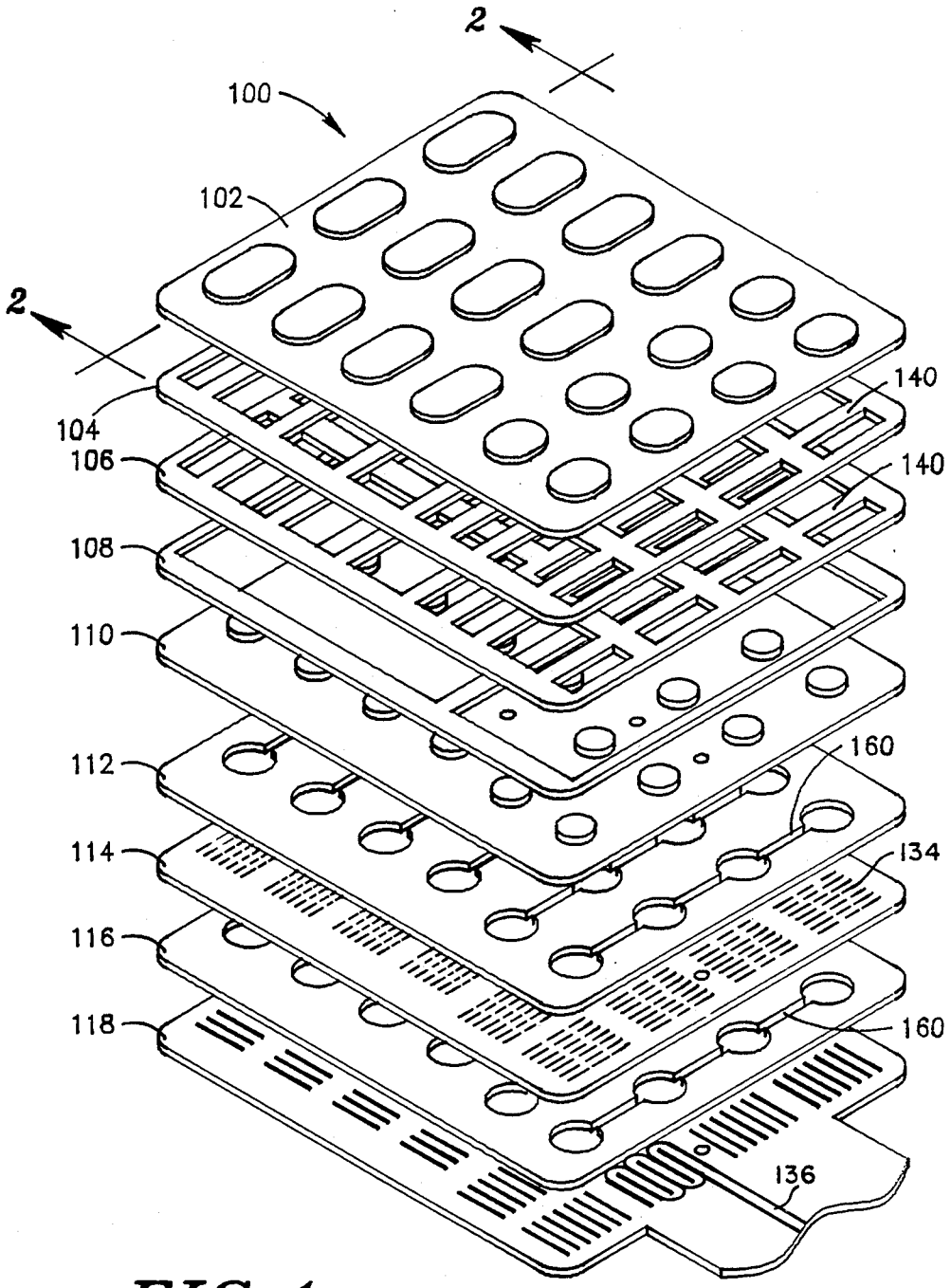
FIG. 1 is an exploded perspective view of a low-profile rubber keypad embodying the present invention.

In FIG. 1, there is illustrated an exploded perspective view of a low-profile rubber keypad 100 embodying the present invention. Keypad 100 may be advantageously utilized in a cellular portable telephone as the user entry device. According to a feature of the present invention, keypad 100 is adhesive backed to facilitate mounting on a surface of the cellular portable telephone.

Figure 2:
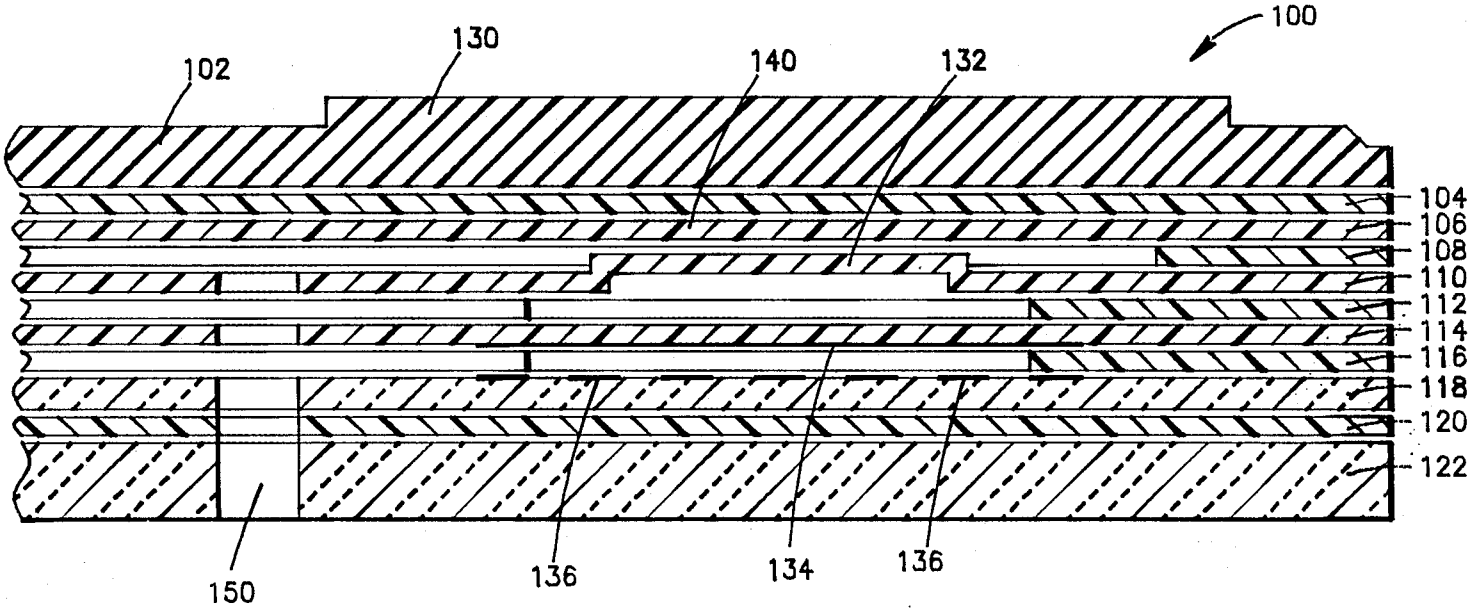
FIG. 2 is a partial cross-sectional view of the low-profile rubber keypad in FIG. 1 taken along lines 2—2.

Referring to FIG. 2, there is illustrated a partial cross-sectional view of a single key 130 of the low-profile rubber keypad 100 in FIG. 1 taken along lines A-A. In the preferred embodiment, keypad 100 includes a plurality of layers 102–120 which are adhesively attached to one another. All layers 102-120 of keypad 100 have been designed to be clear or translucent such that rubber overlay 102 may be back illuminated form a light source by means of diffuser plate 122.

Referring to FIGS. 1 and 2, the top layer of keypad 100 is a silicone rubber overlay 102 having a top surface with a plurality of protruding keys and a flat bottom surface. Other materials may be used for overlay 102, such as, for example, an embossed polyester sheet for reduction in the thickness of keypad 100. Rubber overlay includes a 0.030 inch thick flat backing with 0.015 inch thick protruding keys molded thereto (overall thickness of 0.045 inch). Rubber overlay 102 is bonded to actuation layer 106 by a 0.002 inch thick silicone rubber adhesive layer 104, which has the same physical configuration as the actuation layer 106. Actuation layer 106 is 0.005 inch thick and comprised of a die-cut polyester sheet which has been formed such that thin actuating strips 140, approximately 0.060 inch wide will lay over the top of each embossed dome 132 on the tactile layer 110. Actuation layer 106 is bonded to the tactile layer 110 at the periphery thereof and in an area that separates the two sizes of keys on rubber overlay 102. The thickness of adhesive layer 108 is 0.007 inches. The required thickness for rubber overlay 102 with good tactile feel is reduced by using actuating strips 140 over the embossed polyester domes 132.

Tactile layer 110 of keypad 100 includes a plurality of collapsible resilient domes 132 each opposite a corresponding key 130 and is bonded to the shorting layer 114 by adhesive layer 112 substantially over their entire adjacent surfaces except for areas corresponding to each dome 132. The thickness of adhesive layer 112 is 0.007 inches. Shorting layer 114 includes on its bottom surface a plurality of conductors 134 (shown in dashed lines in FIG. 1) substantially opposite corresponding keys 130 and is bonded to flex circuit layer 118 by adhesive layer 116 substantially over their entire adjacent surfaces except for areas corresponding to each dome 132 of tactile layer 110. Adhesive layer 116 is identical to adhesive layer 112. Flex circuit layer 118 includes on its top surface a plurality of conductors 136 (see representative conductors pair shown in FIG. 1) substantially opposite corresponding conductors 134 and is bonded to double-sided adhesive layer 120 substantially over their entire adjacent surfaces for attaching keypad 100 to a substrate, such as, for example, the cellular telephone housing or a circuit board. In the preferred embodiment, keypad 100 is attached to a diffuser plate 122 coupled to a light source for back illuminating keys 130.

The operation of keypad 100 occurs when the operator's finger depresses a rubber key 130. The force from the operator's finger is effectively concentrated on actuating strip 140 of the actuation layer 106 beneath the key 130. The actuating strip 140 depresses a corresponding dome 132 on tactile layer 110. Dome 132 on the tactile layer 110 then collapses which results in a switch closure, i.e. electrical continuity between conductors 136 on flex circuit layer 118 by way of one or more conductors 134 on shorting layer 114. The configuration of adhesive layers 104, 108, 112 and 116 prevents early contact between conductors 134 and 136, excessive preload of polyester domes 132, and together with holes 150 aides in the venting of air within keypad 100.

According to a feature of the present invention, rubber overlay 102, adhesive layer 104 and actuation layer 106 essentially float above tactile layer 110 since adhesive layer 108 is disposed between actuation layer 106 and tactile layer 110 only at the perimeter of keypad 100 and between the two sizes of keys 130. By floating rubber overlay 102, adhesive layer 104 and actuation layer 106, the air volume between actuation layer 106 and tactile layer 110 does not unduely increase the force necessary to depress keys 130. The tactile feel of keys 130 and the air volume between actuation layer 106 and tactile layer 110 is further controlled by means of holes 150. Hole 150 intersect the air passages e.g. 160 and 162 in adhesive layers 112 and 116. One hole 150 has been provided for each of the rows of keys 130, which are interconnected by corresponding air passages e.g. 160 and 162 in adhesive layers 112 and 116. In the preferred embodiment, four holes 150 are used for the larger twelve digits, and two holes 150 are used for the smaller eight function keys.

The backlighting of keypad 100 occurs when light from diffuser plate 122 washes the back of flex circuit layer 118. Since all layers 102–120 are clear or translucent, light from diffuser plate is dispersed throughout keypad 100. Conductors 134 on flex circuit layer 118 and the conductors 136 on shorting layer 114 are gold and silver, respectively. Conductors 134 and 136 are relatively thin (0.03 mm in width) and separated by a space approximately twice their width. Conductors 136 on flex circuit layer 118 are arranged perpendicular to conductors 134 on shorting layer 114. The resulting cross-hatch pattern of conductors 134 and 136 causes good light dispersion. The light from diffuser plate 122 is further scattered by the embossed tactile domes 132.

Applications of keypad 100 in harsh environments are limited primarily by the environmental characteristics of embossed polyester domes 132 on tactile layer 110. In the preferred embodiment, embossed polyester domes 132 are capable of withstanding 85 degrees Centrigrade and 85–90% relative humidity for a minimum of 130 hours. Domes 132 and thus keypad 100 can also withstand thermal shock cycling of −40 degrees Centrigrade to +85 degrees Centrigrade. If keypad 100 is vented into a water and dust resistant housing, keypad 100 will likewise be water and dust resistant. Keypad 100 is expected to have a lifetime of at least one million actuations minimum.

In summary, a unique low-profile multi-layer rubber keypad has been described which has good tactile feedback and back illuminability. Tactile feedback of the keypad is enhanced by floating the rubber overlay on which protruding keys are formed. The novel keypad is back illuminated through the layers thereof including the intervening switching and circuitry layers. The keypad of the present invention may be advantageously utilized in any applications where small size, backlighting, and good tactile feel are desired.

We claim:

1. A keypad comprising in combination:

a rubber overlay having a top surface with a plurality of protruding portions producing keys, and having a substantially flat bottom surface;

a first adhesive layer having an outer edge portion bonded to the bottom surface of the rubber overlay at the periphery thereof;

an actuation layer having a top surface bonded by the first adhesive layer to the rubber overlay, having a bottom surface, and having a plurality of pairs of cavities each separated by an actuating strip thereof, each actuating strip being substantially aligned with a corresponding key;

a second adhesive layer having an outer edge portion bonded to the bottom surface of the actuation layer at the periphery thereof;

a tactile layer having a top surface bonded by the second adhesive layer to the actuation layer, having a bottom surface, and having a plurality of collapsible resilient domes, each dome being substantially aligned with a corresponding actuation layer and key;

a third adhesive layer having a plurality of cavities each substantially aligned with a corresponding key and being bonded to the bottom surface of the tactile layer;

a shorting layer having a top surface bonded by the third adhesive layer to the tactile layer, having a bottom surface, and having a plurality of conductive areas thereon, each conductive area being substantially aligned with a corresponding key; and a fourth adhesive layer having a plurality of cavities each substantially aligned with a corresponding key and being bonded to the bottom surface of the shorting layer;

a circuitry layer having a top surface bonded by the fourth adhesive layer to the shorting layer, having a bottom surface, and having a plurality of conductor pairs, each conductor pair being substantially aligned with a corresponding conductive area of said shorting layer, whereby depression of a key and corresponding actuating strip collapses a corresponding dome to produce contact between a corresponding conductive area and a conductor pair.

2. The keypad according to claim 1, wherein said first adhesive layer further includes a plurality of pairs of cavities each separated by an actuating strip thereof, each actuating strip of the first adhesive layer being substantially aligned with an actuating strip of the actuation layer.

3. The keypad according to claim 1, wherein said circuitry layer is adhesive backed.

4. The keypad according to claim 1, wherein said tactile layer, shorting layer and circuitry layer each further include at least one venting hole which intersect and interconnect air passages of said third and fourth adhesive layers.

5. A keypad adapted to be surface mounted to a substrate, comprising:

a rubber overlay having a top surface with a plurality of protruding portions producing keys, and having a substantially flat bottom surface;

a first adhesive layer having an outer edge portion bonded to the bottom surface of the rubber overlay at the periphery thereof;

an actuation layer having a top surface bonded by the first adhesive layer to the rubber overlay, having a bottom surface, and having a plurality of pairs of cavities each separated by an actuating strip thereof, each actuating strip being substantially aligned with a corresponding key;

a second adhesive layer having an outer edge portion bonded to the bottom surface of the actuation layer at the periphery thereof;

a tactile layer having a top surface bonded by the second adhesive layer to the actuation layer, having a bottom surface, and having a plurality of collapsible resilient domes, each dome being substantially aligned with a corresponding actuation layer and key;

a third adhesive layer having a plurality of cavities each substantially aligned with a corresponding key and being bonded to the bottom surface of the tactile layer;

a shorting layer having a top surface bonded by the third adhesive layer to the tactile layer, having a bottom surface, and having a plurality of conductive areas thereon, each conductive area being substantially aligned with a corresponding key;

a fourth adhesive layer having a plurality of cavities each substantially aligned with a corresponding key and being bonded to the bottom surface of the shorting layer;

a circuitry layer having a top surface bonded by the fourth adhesive layer to the shorting layer, having a bottom surface, and having a plurality of conductor pairs, each conductor pair being substantially aligned with a corresponding conductive area of said shorting layer, whereby depression of a key and corresponding actuating strip collapses a corresponding dome to produce contact between a corresponding conductive area and conductor pair; and a fifth adhesive layer bonded to the bottom surface of the circuitry layer for bonding said circuitry layer to the substrate.

6. The keypad according to claim 5, wherein said first adhesive layer further includes a plurality of pairs of cavities each separated by an actuating strip thereof, each actuating strip of the first adhesive layer being substantially aligned with an actuating strip of the actuation layer.

7. The keyboard according to claim 5, wherein said tactile layer, shorting layer and circuitry layer each further include at least one venting hole which intersect and interconnect air passages said third and fourth adhesive layers.

* * * * *

UNITED STATES PATENT AND TRADEMARK OFFICE

CERTIFICATE OF CORRECTION

PATENT NO. : 4,916,262

DATED : April 10, 1990

INVENTOR(S) : Jungles-Butler et al.

It is certified that error appears in the above-identified patent and that said Letters Patent is hereby corrected as shown below:

In Column 1, line 55, delete "A-A" and insert with --2-2--.

Signed and Sealed this

Seventh Day of April, 1992

*Attest:*

HARRY F. MANBECK, JR.

*Attesting Officer*

*Commissioner of Patents and Trademarks*